US008579043B2

(12) United States Patent
Hirayama et al.

(10) Patent No.: US 8,579,043 B2
(45) Date of Patent: Nov. 12, 2013

(54) BATTERY-POWERED POWER TOOLS

(75) Inventors: Toshiro Hirayama, Anjo (JP); Shinji Onoda, Anjo (JP); Hitoshi Iida, Anjo (JP); Kenji Abe, Anjo (JP); Munetoshi Goto, Anjo (JP)

(73) Assignee: Makita Corporation, Anjo-Shi (JP)

( * ) Notice: Subject to any disclaimer, the term of this patent is extended or adjusted under 35 U.S.C. 154(b) by 231 days.

(21) Appl. No.: 12/903,416

(22) Filed: Oct. 13, 2010

(65) Prior Publication Data

US 2011/0088922 A1 Apr. 21, 2011

(30) Foreign Application Priority Data

Oct. 20, 2009 (JP) ..... 2009-241657

(51) Int. Cl.
*B25D 11/04* (2006.01)

(52) U.S. Cl.
USPC ..... 173/109; 173/170; 173/201; 173/216; 173/217

(58) Field of Classification Search
USPC ..... 173/104, 109, 216, 217, 162.2, 170, 173/201, 48; 310/47, 50
See application file for complete search history.

(56) References Cited

U.S. PATENT DOCUMENTS 4,930,583 A * 6/1990 Fushiya et al. ..... 173/109
5,149,230 A * 9/1992 Nett ..... 408/42
5,653,296 A * 8/1997 Fujiyama ..... 173/217
5,816,121 A * 10/1998 Yoshimizu et al. ..... 81/469
5,902,080 A 5/1999 Kopras
5,947,210 A * 9/1999 Sasaki et al. ..... 173/178
6,170,579 B1 * 1/2001 Wadge ..... 173/216
6,315,060 B1 * 11/2001 Schuda et al. ..... 173/132
6,499,643 B1 * 12/2002 Hewitt ..... 227/131
6,729,415 B1 * 5/2004 Huang ..... 173/217
6,843,330 B2 * 1/2005 Schmid et al. ..... 173/217
6,871,711 B2 * 3/2005 Hansson ..... 173/216
6,929,074 B1 * 8/2005 Lai ..... 173/178
7,096,974 B2 * 8/2006 Obermeier et al. ..... 173/217

(Continued)

FOREIGN PATENT DOCUMENTS

DE 20 2008 014 976 U1 3/2009
EP 0 995 551 A2 4/2000

(Continued)

OTHER PUBLICATIONS

Search Report issued in European Application No. EP 10 18 7703 dated Feb. 17, 2011.

*Primary Examiner* — Scott A. Smith
(74) *Attorney, Agent, or Firm* — Oliff & Berridge, PLC

(57) ABSTRACT

It is an object of the invention to provide a technique for bringing a center of gravity of a battery-powered power tool closer to a working axis of a tool bit in the battery-powered power tool.

The battery-powered power tool performs an operation by movement of a tool bit 119 in an axial direction of the tool bit. The power tool includes a battery 110, a motor 111 that is driven by power supply from the battery 110, a mechanical arrangement 113, 115, 117 that drives the tool bit 119 by rotative power transmitted from the motor 111, and a tool body 103 that houses the motor 111 and the mechanical arrangement 113, 115, 117 and has a front end region in which the tool bit 119 is disposed. A sum of weights of the motor 111 and the battery 110 is smaller than a weight of the mechanical arrangement 113, 115, 117.

10 Claims, 1 Drawing Sheet

(56) References Cited

U.S. PATENT DOCUMENTS

| | | | | |
|---|---|---|---|---|
| 7,306,049 | B2 | 12/2007 | Soika et al. | |
| 7,331,408 | B2 * | 2/2008 | Arich et al. | 173/201 |
| 7,494,035 | B2 * | 2/2009 | Weaver et al. | 227/2 |
| 7,497,272 | B2 * | 3/2009 | Strasser et al. | 173/48 |
| 7,497,275 | B2 * | 3/2009 | Brotto | 173/217 |
| 7,694,750 | B2 * | 4/2010 | Tsubakimoto et al. | 173/178 |

FOREIGN PATENT DOCUMENTS

| | | |
|---|---|---|
| EP | 1 795 311 A2 | 6/2007 |
| JP | A-2006-175592 | 7/2006 |
| JP | A-2008-238300 | 10/2008 |

* cited by examiner

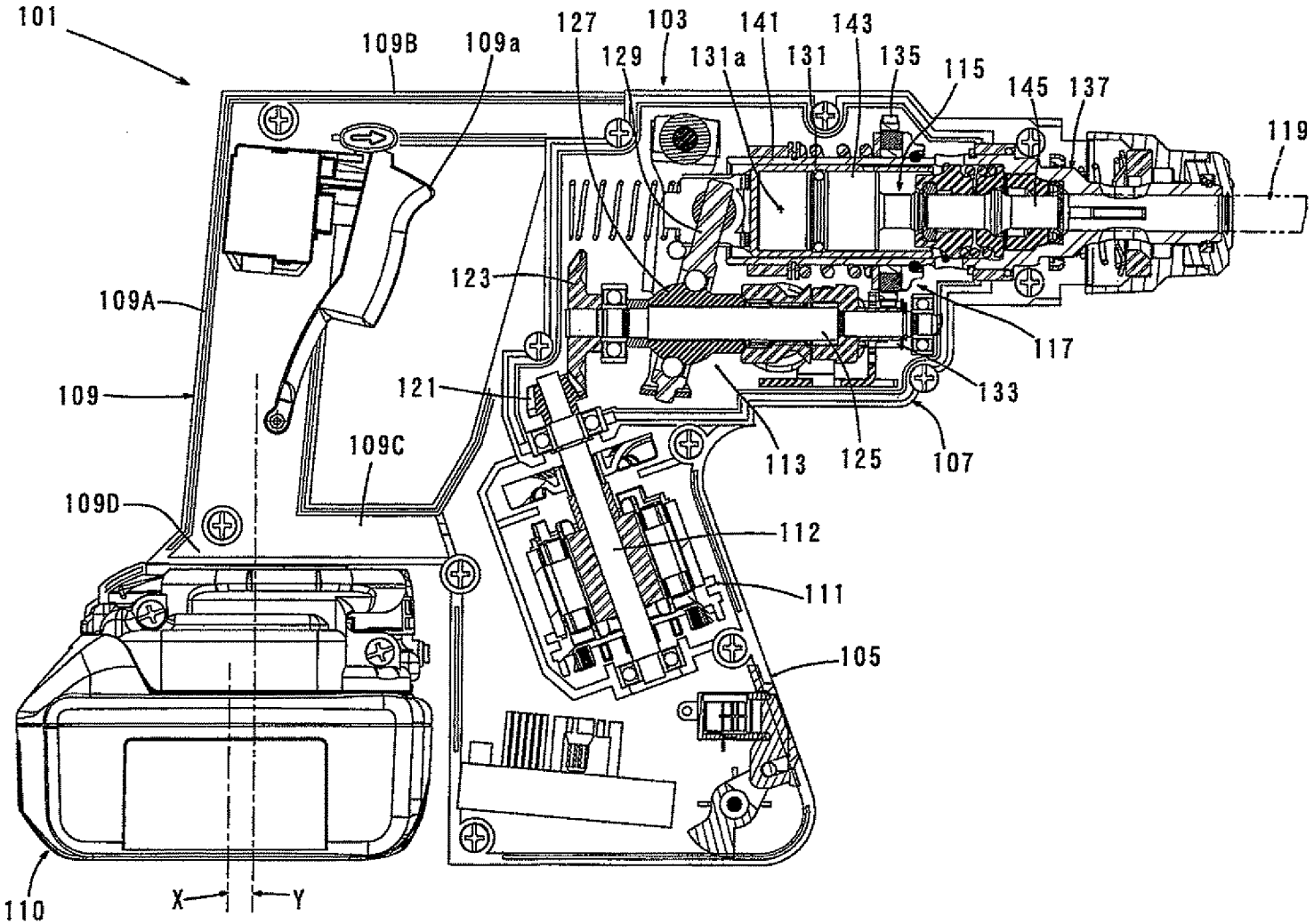
119
137
145
115
135
143
131
141
131a
103
129
127
109a
109B
101
109A
109
109D
123
121
109C
117
133
107
125
113
112
111
105
Y
X
110

BATTERY-POWERED POWER TOOLS

BACKGROUND OF THE INVENTION

1. Field of the Invention

The invention relates to a battery-powered power tool which drives a motor by a battery.

2. Description of the Related Art

Japanese non-examined laid-open Patent Publication No. 2006-175592 discloses a battery-powered electric hammer drill having a battery for driving a motor. According to this known art, the motor powered by the battery and a mechanical arrangement are housed within a tool body in the form of a housing. The mechanical arrangement including a motion converting mechanism for linearly moving the hammer bit in its axial direction and a power transmitting mechanism for rotating the hammer bit around its axis serves to drive a hammer bit by rotative power transmitted from the motor. The motor is disposed such that its axis of rotation extends in a direction transverse to the axial direction or a direction of movement of a tool bit in the form of the hammer bit. Further, a handgrip designed to be held by a user is disposed rearward of a tool body on the tool body opposite from the hammer bit and extends in a direction transverse to the axial direction of the hammer bit. A battery is mounted to an extending end or a lower end of the handgrip rearward of the motor.

A power tool such as a hammer drill is used in various manners, including the manner of performing an operation in a horizontal position by pointing the hammer bit upon a vertical wall, the manner of performing an operation in an upward orientation by pointing the hammer bit upon a ceiling, and the manner of performing an operation in a downward orientation by pointing the hammer bit upon a floor. Therefore, in order to alleviate the user's fatigue, it is important to enhance the usability (ease of use) in use of the power tool. Particularly, in the case of the hammer drill in which the user holds the handgrip and performs an operation, while applying a forward pressing force and pressing the hammer bit against a workpiece, the greater the vibration in the striking direction of the hammer bit during operation (the longitudinal moment around a center of gravity), the greater the burden upon the user. The magnitude of this moment depends on the position of the center of gravity of the power tool. Specifically, the moment becomes greater as the position of the center of gravity is brought farther away from the axis of the hammer bit.

SUMMARY OF THE INVENTION

Accordingly, it is an object of the invention to provide a technique for bringing a center of gravity of a battery-powered power tool closer to a working axis of a tool bit in the battery-powered power tool.

The above described object can be achieved by the claimed invention. According to a preferred embodiment of the invention, a battery-powered power tool includes a battery, a motor, a mechanical arrangement and a tool body, and performs an operation by movement of a tool bit in an axial direction of the tool bit. The motor is driven by power supply from the battery. The mechanical arrangement drives the tool bit by rotative power transmitted from the motor. Further, the "movement of a tool bit in an axial direction of the tool bit" widely includes not only the manner in which the tool bit moves in the axial direction with respect to the tool body, but the manner in which the tool bit moves in the axial direction together with the tool body. Further, when, for example, the power tool comprises a hammer drill for use in a drilling operation on a workpiece such as a concrete wall, the "mechanical arrangement" represents a mechanical arrangement which serves to convert rotation of the motor into linear motion and strikes the tool bit in the form of a hammer bit in its axial direction and a mechanical arrangement which serves to transmit rotative power of the motor to the hammer bit and cause the hammer bit to rotate around its axis. Further, the "battery-powered power tool" in the invention typically represents an impact tool such as a hammer and a hammer drill for use in a chipping operation and a drilling operation on a workpiece, but it also widely includes a screw tightening tool for use in a screw tightening operation, and a driving tool for driving in nails, staples and the like.

According to the invention, sum of the weights of the motor and the battery is provided to be smaller than the weight of the mechanical arrangement. The motor and the battery are disposed at a position farther away from the working axis of the tool bit than the mechanical arrangement for driving the tool bit, in a direction transverse to the working axis of the tool bit. Therefore, with such a construction in which the sum of the weights of the motor and the battery is smaller than the weight of the mechanical arrangement, the center of gravity of the power tool can be brought closer to the working axis of the tool bit, so that vibration caused around the center of gravity in the axial direction of the tool bit during operation, or particularly a longitudinal moment can be reduced. As a result, a burden on the user can be alleviated and usability can be improved.

According to a further aspect the battery-powered power tool in the invention, the tool bit comprises a hammer bit that moves at least linearly in the axial direction, and the mechanical arrangement includes a striking element that moves linearly in the axial direction of the hammer bit and strikes the hammer bit.

With such construction, vibration caused in the axial direction of the hammer bit during operation can be reduced, in an impact tool such as a hammer in which a hammer bit performs striking movement in the axial direction, and a hammer drill in which a hammer bit rotates around its axis while performing striking movement.

According to a further aspect of the battery-powered power tool in the invention, the power tool has a grip that is disposed on a side of the mechanical arrangement opposite from the tool bit and designed to be held by a user. Further, at least part of the grip is located in a rear region on a working axis of the tool bit. With such a construction in which at least part of the grip is disposed on the working axis of the tool bit, when the user holds the grip and performs an operation while pressing the tool bit against the workpiece, it is made easier for the user to press the tool bit against the workpiece, so that usability of the power tool can be improved.

According to a further aspect of the battery-powered power tool in the invention, the motor is disposed such that an axis of rotation of the motor obliquely crosses the working axis extending in the axial direction of the tool bit. With such an oblique arrangement, compared with an orthogonal arrangement, the center of gravity of the motor can be brought closer to the working axis of the tool bit. As a result, the center of gravity of the power tool itself can be brought closer to the working axis of the tool bit.

According to a further aspect of the battery-powered power tool in the invention, the power tool has a grip that is disposed on a side of the mechanical arrangement opposite from the tool bit and designed to be held by a user. The grip extends in a direction transverse to the axial direction of the tool bit and the battery is mounted to one end of the grip in the extending direction. Further, a central axis of the battery is located on a side of a central axis of the grip opposite from the tool bit. With such arrangement, the position of the center of gravity of the power tool is displaced from the tool bit side to the grip side. Specifically, the center of gravity of the power tool is brought closer to the central axis of the grip, so that a front end portion of the body 103 becomes lighter in weight. Therefore, usability can be improved.

According to a further aspect of the battery-powered power tool in the invention, the motor comprises a DC brushless motor. The DC brushless motor not only has a low noise level and a long service life, but also can be reduced in size, so that it is made useful for weight reduction of the power tool.

According to a further aspect of the battery-powered power tool in the invention, the battery comprises a lithium-ion battery. By using a lithium-ion battery as the battery, the power tool can be reduced in weight without causing power reduction.

According to the invention, a technique is provided which contributes to enhancement of usability by bringing a center of gravity of a battery-powered power tool closer to a working axis of the tool bit in the battery-powered power tool. Other objects, features and advantages of the present invention will be readily understood after reading the following detailed description together with the accompanying drawings and the claims.

BRIEF DESCRIPTION OF THE DRAWINGS

FIG. 1 is a sectional view showing an entire hammer drill according to an embodiment of the invention.

DETAILED DESCRIPTION OF THE INVENTION

Each of the additional features and method steps disclosed above and below may be utilized separately or in conjunction with other features and method steps to provide and manufacture improved battery-powered power tool and method for using such battery-powered power tool and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

An embodiment of the invention is now described with reference to FIG. 1. In this embodiment, an electric hammer drill is explained as a representative example of a battery-powered power tool according to the invention. As shown in FIG. 1, a hammer drill 101 of this embodiment mainly includes a body 103 that forms an outer shell of the hammer drill 101, and a hammer bit 119 detachably coupled to a front end region of the body 103 (on a left side as viewed in FIG. 1) via a tool holder 137. The body 103 and the hammer bit 119 are features that correspond to the "tool body" and the "tool bit", respectively, according to the invention. Further, the hammer bit 119 is held by the tool holder 137 such that it is allowed to reciprocate with respect to the tool holder 137 in its axial direction and prevented from rotating with respect to the tool holder 137 in its circumferential direction. For the sake of convenience of explanation, in a horizontal position of the body 103 in which the axial direction of the hammer bit 119 coincides with a horizontal direction, the side of the hammer bit 119 is taken as the front and the side opposite from the hammer bit 119 as the rear.

The body 103 is formed by a housing of a two-part structure having two halves and integrally includes a motor housing part 105 that houses a driving motor 111, a gear housing part 107 that houses a motion converting mechanism 113, a striking mechanism 115 and a power transmitting mechanism 117, and a handgrip 109 designed to be held by a user. The motion converting mechanism 113, the striking mechanism 115 and the power transmitting mechanism 117 form a driving mechanism of the hammer bit 119. The driving mechanism and the handgrip 109 are features that correspond to the "mechanical arrangement" and the "grip", respectively, according to the invention. In a state in which the axial direction of the hammer bit 119 coincides with a horizontal direction, the motor housing part 105 is formed below the gear housing part 107. The handgrip 109 is formed at the rear of the gear housing part 107.

The motion converting mechanism 113 appropriately converts a rotating output of the driving motor 111 into linear motion and then transmits it to the striking mechanism 115. As a result, an impact force is generated in the axial direction of the hammer bit 119 (the horizontal direction as viewed in FIG. 1) via the striking mechanism 115. Further, the power transmitting mechanism 117 appropriately reduces the speed of the rotating output of the driving motor 111 and transmits it to the hammer bit 119, so that the hammer bit 119 is caused to rotate in the circumferential direction. The driving motor 111 is a feature that corresponds to the "motor" in this invention. The driving motor 111 is arranged such that an extension of an axis of an output shaft 112 (an axis of rotation of the motor) is inclined rearward with respect to an axis of the hammer bit 119 and crosses it. In this embodiment, a DC (direct-current) brushless motor is used as the driving motor 111. The driving motor 111 is driven when a user depresses a trigger 109*a* disposed on a grip part 109A of the handgrip 109.

The handgrip 109 has the grip part 109A that extends in a vertical direction transverse to the axial direction of the hammer bit 119, and connecting parts 109B, 109C that extend forward from upper and lower ends of the grip part 109A. The upper connecting part 109E is connected to the rear end of the gear housing part 107 and the lower connecting part 109C is connected to the rear end of the motor housing part 105. Thus, the handgrip 109 comprises a loop-shaped handle (D-shaped handle). A battery mounting part 109D is formed on the lower connecting part 109C or one extending end of the grip part 109A of the handgrip 109, and a battery pack 110 is detachably mounted to the battery mounting part 109D.

The battery pack 110 is disposed behind the motor housing part 105 and a lower end surface of the battery pack 110 is substantially in flush with the lower end surface of the motor housing part 105. Further, a central axis X of the battery pack 110 is located rearward of a central axis Y of the grip part A of the handgrip 109. The battery pack 110 is a container packed with a plurality of rechargeable batteries for supplying power to the driving motor 111, and in this embodiment, 18-volt lithium-ion secondary batteries are used as the rechargeable batteries. The battery pack 110 is a feature that corresponds to the "battery" according to the invention.

The motion converting mechanism 113 mainly includes an intermediate shaft 125, a swinging member in the form of a swinging ring 129 and a cylindrical piston 131. The intermediate shaft 125 is rotated via a small bevel gear 121 and a large bevel gear 123 by the output shaft 112 of the driving motor 111. The swinging ring 129 is caused to swing in the axial direction of the intermediate shaft 125 (the axial direction of the hammer bit 119) via a rotating element 127 by rotation of the intermediate shaft 125. The cylindrical piston 131 is caused to linearly reciprocate in the axial direction of the hammer bit 119 within a cylinder 141 by swinging movement of the swinging ring 129. Further, the cylinder 141 is a cylindrical member that is integrally formed at the rear of the tool holder 137. The power transmitting mechanism 117 mainly includes a gear speed reducing mechanism having a plurality of gears such as a first spur gear 133 that has a small diameter and rotates together with the intermediate shaft 125, and a second spur gear 135 that has a large diameter and engages with the first spur gear 133. The power transmitting mechanism 117 serves to transmit torque of the driving motor 111 to the tool holder 137. Thus, when the tool holder 137 is caused to rotate in a vertical plane, the hammer bit 119 held by the tool holder 137 is caused to rotate. Further, the constructions of the motion converting mechanism 113 and the power transmitting mechanism 117 are known, and therefore their detailed descriptions are omitted.

The striking mechanism 115 mainly includes a striking element in the form of a striker 143 that is slidably disposed within the cylindrical piston 131 and an intermediate element in the form of an impact bolt 145 that is slidably fitted in the tool holder 137. The striker 143 is driven via an action of an air spring function (pressure fluctuations) of an air chamber 131*a* caused by sliding movement of the cylindrical piston 131 and then collides with (strikes) the impact bolt 145, so that a striking force is transmitted to the hammer bit 119 via the impact bolt 145.

In the hammer drill 101 constructed as described above, when the driving motor 111 is driven by depressing the trigger 109*a* with user's finger, the rotating output of the driving motor 111 is converted to linear motion via the motion converting mechanism 113 and then causes the hammer bit 119 to perform a linear movement (hammering movement) in the axial direction via the striking mechanism 115. Further, the hammer bit 119 is caused to perform not only the above-described linear movement, but a rotating movement (drilling movement) in the circumferential direction via the power transmitting mechanism 117 driven by the rotating output of the driving motor 111. Specifically, the hammer drill 101 can perform a drilling operation on a workpiece by causing the hammer bit 119 to perform hammering movement in the axial direction and drilling movement in the circumferential direction with the hammer bit 119 pressed against a workpiece (such as concrete).

In the case of the hammer drill 101, the user performs an operation while holding the handgrip 109 and applying a forward pressing force to the workpiece, and the greater the vibration in the striking direction of the hammer bit 119, or particularly the greater the moment in the longitudinal direction of the hammer drill around its center of gravity, during the operation, the greater the burden upon the user. The magnitude of this moment depends on the position of the center of gravity of the hammer drill 101. In the construction in which the driving motor 111 and the battery pack 110 are disposed at a lower position farther away from the axis of the hammer bit 119 than the driving mechanism of the hammer bit 119 in a vertical direction transverse to the axial direction of the hammer bit 119, generally, the center of gravity of the hammer drill 101 is located below the axis of the hammer bit 119.

In this embodiment, a DC brushless motor is used as the driving motor 111 and 18-volt lithium-ion secondary batteries are used in the battery pack 110. With such a construction, the sum of the weights of the battery pack 110 and the driving motor 111 (hereinafter referred to as the weight of the motor, etc.) is designed to be smaller than the total weight of the motion converting mechanism 113, the striking mechanism 115 and the power transmitting mechanism 117 (hereinafter referred to as the weight of the mechanical arrangement) which form the driving mechanism for linearly driving the hammer bit 119 in its axial direction and rotating the hammer bit 119 around its axis. Further, the driving mechanism more specifically represents a series of members which is covered from the output shaft 112 to the impact bolt 145 and serves to convert rotation of the driving motor 111 into linear motion and strike the hammer bit 119, and a series of members which is covered from the output shaft 112 to the tool holder 137 and serves to transmit rotative power of the driving motor 111 to the hammer bit 119 (some of the members serve both of the linearly driving function and the rotationally driving function).

In a conventional hammer drill of the same type manufactured by applicant of this invention, a weight ratio of the driving mechanism of the hammer bit to the motor, etc. is 1 to approximately 1.2. In this embodiment, however, with the above-described construction in which a DC brushless motor is used as the driving motor 111 and 18-volt lithium-ion secondary batteries are used in the battery pack 110, the weight ratio of the driving mechanism of the hammer bit 119 to the motor, etc. can be set to 1 to approximately 0.9.

By provision of the construction in which the weight of the motor, etc. is lighter than that of the driving mechanism as described above, the position of the center of gravity of the hammer drill 101 is displaced upward. Specifically, according to this embodiment, compared with the known hammer drill, the center of gravity of the hammer drill 101 can be brought closer to the axis (working axis) of the hammer bit 119. Therefore, when the user holds the handgrip 109 and performs an operation, while applying a forward pressing force to the body 103 and pressing the hammer bit 119 against a workpiece, vibration caused around the center of gravity in the axial direction by the striking movement of the hammer bit 119, or particularly a longitudinal moment can be reduced. As a result, a burden on the user can be alleviated and usability or ease of operation can be improved. Further, by provision of the construction in which the driving motor 111 comprises a DC brushless motor and the battery pack 110 comprises 18-volt lithium-ion secondary batteries, weight reduction of the hammer drill 101 can also be realized without causing power reduction.

Further, in this embodiment, the handgrip 109 connected to the rear end of the body 103 (on the side opposite from the hammer bit 119) is disposed on the extension of the axis of the hammer bit 119. Therefore, when the user holds the grip part 109A of the handgrip 109 and performs an operation while pressing the hammer bit 119 against the workpiece, it is made easier for the user to press the hammer bit 119 against the workpiece. Specifically, the user can hold the hammer bit 119 in contact with the workpiece by relatively weak force, so that usability can be enhanced.

Further, according to this embodiment, the driving motor 111 is arranged such that the output shaft 112 is inclined rearward in a direction transverse to the axial direction of the hammer bit 119. With such an inclined arrangement, compared with an orthogonal arrangement, the position of the center of gravity of the driving motor 111 can be displaced upward toward the axis of the hammer bit 119, so that the center of gravity of the hammer drill 101 can be brought closer to the axis of the hammer bit 119.

Further, according to this embodiment, the battery pack 110 is disposed on the battery mounting part 109D of the handgrip 109 such that the central axis X of the battery pack 110 is located rearward of the central axis Y of the grip part 109A of the handgrip 109. With such an arrangement, the position of the center of gravity of the hammer drill 101 is displaced rearward. Thus, the center of gravity of the hammer drill 101 is brought closer to the central axis X of the handgrip 109, so that the hammer drill 101 has a better balance of weight in the axial direction of the hammer bit 119 (the longitudinal direction). Specifically, a front end portion of the body 103 relatively becomes lighter in weight, so that usability of the hammer drill 101 can be improved.

Further, in the above-described embodiment, the hammer drill 101 is explained in which the hammer bit 119 performs hammering movement in its axial direction and drilling movement around its axis. However, this invention can also be applied to a hammer in which the hammer bit 119 only performs hammering movement in its axial direction.

Further, this invention can be applied not only to an impact tool such as a hammer drill and a hammer, but also to a screw tightening tool, such as an impact driver which can perform a screw tightening operation by rotating a driver bit while applying an impact to the driver bit around its axis and a screw driver which performs a screw tightening operation by rotating a driver bit around its axis, and further to various kinds of driving tools which drive in nails or staples by linear movement of the driver in its axial direction.

DESCRIPTION OF NUMERALS

101 hammer drill (battery-powered power tool)
103 body (tool body)
105 motor housing part
107 gear housing part
109 handgrip (grip)
109A grip part
109B upper connecting part
109C lower connecting part
109D battery mounting part
109*a* trigger
110 battery pack (battery)
111 driving motor
112 output shaft
113 motion converting mechanism (mechanical arrangement)
115 striking mechanism (mechanical arrangement)
117 power transmitting mechanism (mechanical arrangement)
119 hammer bit (tool bit)
121 small bevel gear
123 large bevel gear
125 intermediate shaft
127 rotating element
129 swinging ring
131 cylindrical piston
131*a* air chamber
133 first spur gear
135 second spur gear
137 tool holder
141 cylinder
143 striker
145 impact bolt

The invention claimed is:

1. A battery-powered power tool that performs an operation by movement of a tool bit in an axial direction of the tool bit, including:

a battery, a motor that is driven by power supply from the battery, a mechanical arrangement including a motion converting mechanism, a striking mechanism, and a power transmitting mechanism, the mechanical arrangement driving the tool bit by rotative power transmitted from the motor, and a tool body that houses the motor and the mechanical arrangement and has a front end region in which the tool bit is disposed, wherein:

the entire motor is disposed not to intersect a central longitudinal axis of the tool bit, a sum of weights of the motor and the battery is smaller than a weight of the mechanical arrangement, and the motion converting mechanism includes a swinging ring and an intermediate shaft that is disposed between the motor and the longitudinal axis of the tool bit.

2. The battery-powered power tool as defined in claim 1, wherein the tool bit is defined by a hammer bit that moves at least linearly in the axial direction, and the mechanical arrangement includes a striking element that moves linearly in the axial direction of the hammer bit and strikes the hammer bit.

3. The battery-powered power tool as defined in claim 1, further comprising a grip that is disposed on a side of the mechanical arrangement opposite from the tool bit and provided to be held by a user, wherein at least part of the grip is located in a rear region on the longitudinal axis of the tool bit.

4. The battery-powered power tool as defined in claim 1, wherein the motor is disposed such that an axis of rotation of the motor obliquely crosses the longitudinal axis of the tool bit.

5. The battery-powered power tool as defined in claim 1, further comprising a grip that is disposed on a side of the mechanical arrangement opposite from the tool bit and designed to be held by the user, wherein the grip extends in a direction transverse to the axial direction of the tool bit and the battery is mounted to one end of the grip in an extending direction, wherein a central axis of the grip is located on the tool bit side of a central axis of the battery.

6. The battery-powered power tool as defined in claim 1, wherein the motor comprises a DC brushless motor.

7. The battery-powered power tool as defined in claim 1, wherein the battery comprises a lithium-ion battery.

8. The battery-powered power tool as defined in claim 1, wherein a weight ratio of the battery and motor to the mechanical arrangement is 0.9 to less than 1.

9. The battery-powered power tool as defined in claim 1, wherein the intermediate shaft is parallel to the longitudinal axis of the tool bit.

10. The battery-powered power tool as defined in claim 9, wherein the motor is disposed such that an axis of rotation of the motor obliquely crosses both the longitudinal axis of the tool bit and the intermediate shaft.

* * * * *